US006643933B2

(12) United States Patent
Seigneur

(10) Patent No.: US 6,643,933 B2
(45) Date of Patent: Nov. 11, 2003

(54) GUIDE BAR FOR CHAIN SAW INCLUDING STUMP TREATMENT

(75) Inventor: Christopher David Seigneur, West Linn, OR (US)

(73) Assignee: Blount, Inc., Portland, OR (US)

( * ) Notice: Subject to any disclaimer, the term of this patent is extended or adjusted under 35 U.S.C. 154(b) by 103 days.

(21) Appl. No.: 09/839,967

(22) Filed: Apr. 19, 2001

(65) Prior Publication Data

US 2002/0152864 A1 Oct. 24, 2002

(51) Int. Cl.[7] ..... B27B 17/12; B27M 1/00

(52) U.S. Cl. ..... 30/123.4; 83/169; 144/364; 144/34.6

(58) Field of Search ..... 30/123.4, 383; 47/1.5, 8; 83/169; 144/364, 34.6

(56) References Cited

U.S. PATENT DOCUMENTS

| | | | | |
|---|---|---|---|---|
| 3,840,991 A | * | 10/1974 | Arff et al. | 30/383 |
| 5,050,303 A | | 9/1991 | Sinclair | 30/123.4 |
| 5,056,224 A | | 10/1991 | Seigneur | 30/123.4 |
| 5,143,131 A | | 9/1992 | Seigneur | 144/364 |
| 5,426,854 A | | 6/1995 | Leini | 30/123.4 |
| 5,634,273 A | | 6/1997 | Michels | 30/123.4 |
| 5,669,140 A | * | 9/1997 | Tsumura | 30/123.4 |
| 5,778,537 A | | 7/1998 | Leini | 30/123.4 |
| 5,797,187 A | | 8/1998 | Leini | 30/123.4 |
| 5,845,402 A | | 12/1998 | Leini | 30/123.4 |
| 5,862,600 A | * | 1/1999 | Leini et al. | 30/383 X |
| 6,397,475 B1 | * | 6/2002 | Pettersson et al. | 30/123.4 |

* cited by examiner

*Primary Examiner*—Charles Goodman
(74) *Attorney, Agent, or Firm*—Robert L. Harrington; Schwabe Williamson & Wyatt

(57) ABSTRACT

A guide bar for a chain saw of a tree harvester adapted for applying treatment material to the stump upon severing a tree. The guide bar, typically a laminated bar includes an inner channel in the inner laminate that connects to a series of dispersal holes in the outer laminates and along the bar length. Multiple inlet holes also in the outer laminate or laminates are provided in a rear region of the bar for directing material flow into the channel. Only one of the inlet holes is in use and the other inlet holes are plugged. The invention provides for plugging unused inlet holes with a member (plug) that slides into position over the unused inlet holes at the inner side of the outer laminate. Numerous variations are proposed including both automatic, where treatment material flow generates an inner pressure that urges a member against the inner side of the unused hole and manual, where a blocking tab is manually slid into place at the inner side of the hole.

6 Claims, 9 Drawing Sheets

FIG. 8
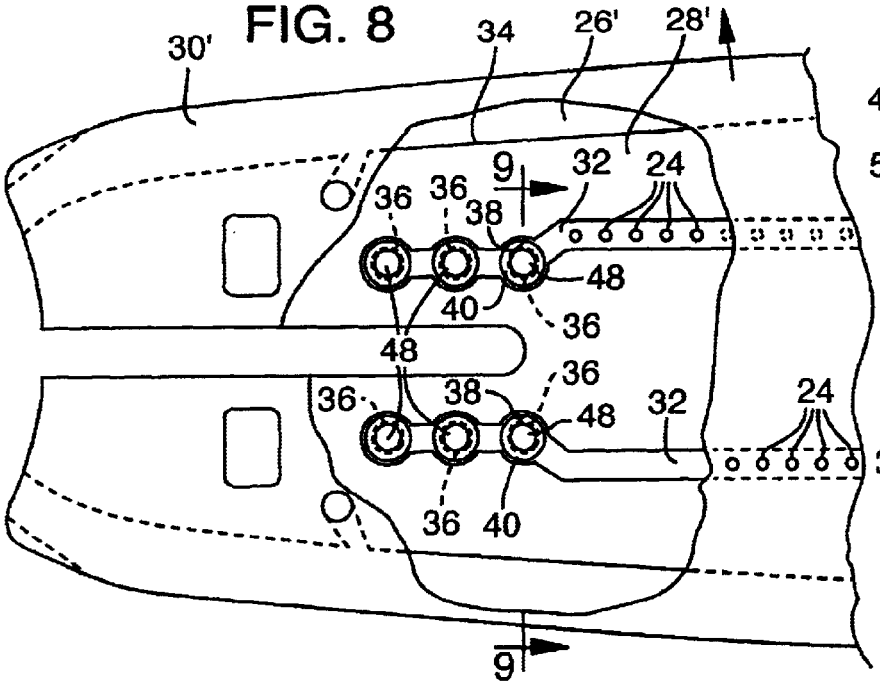
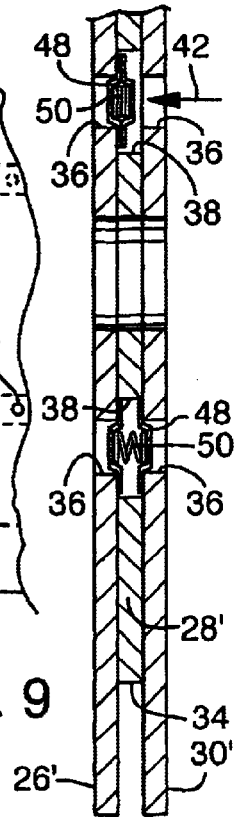
FIG. 9
FIG. 10
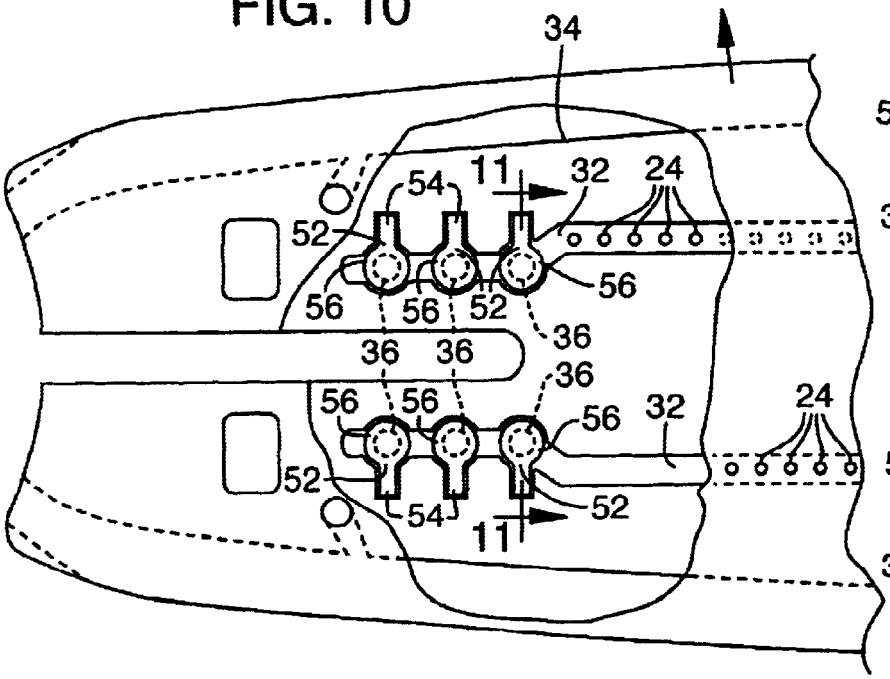
FIG. 11
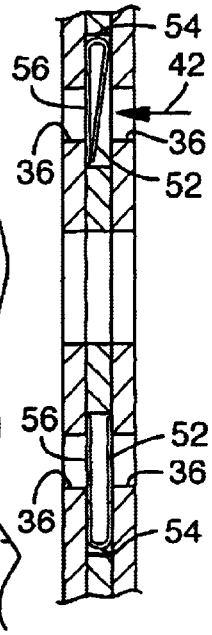

FIG. 23
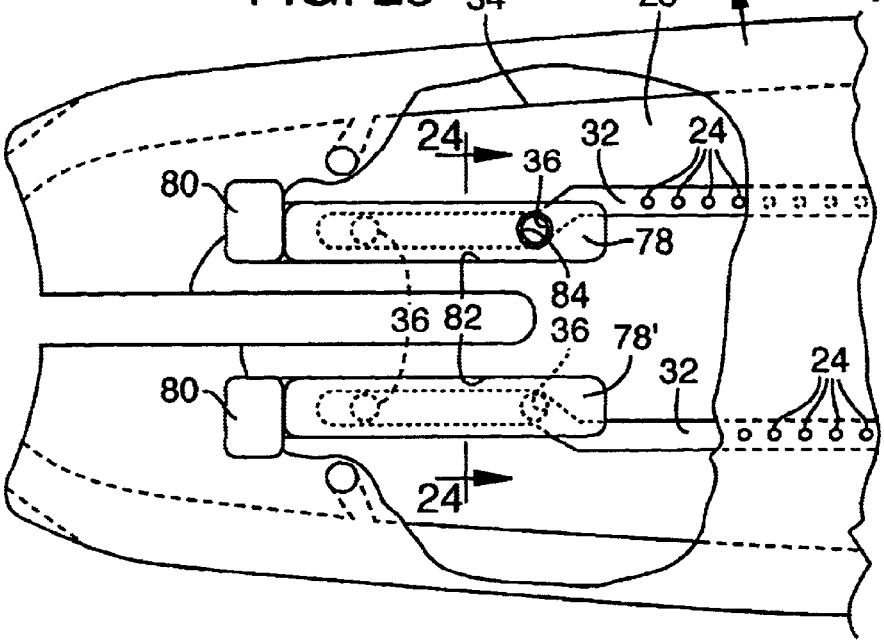
FIG. 24
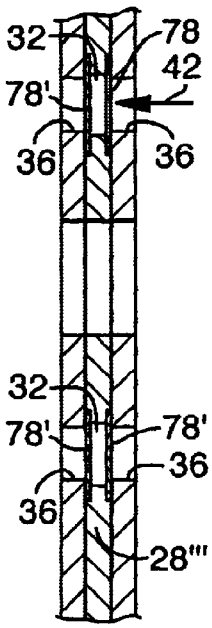
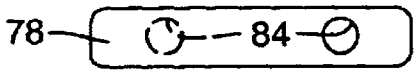
FIG. 25A
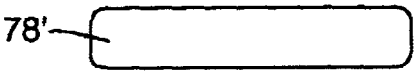
FIG. 25B

FIG. 26
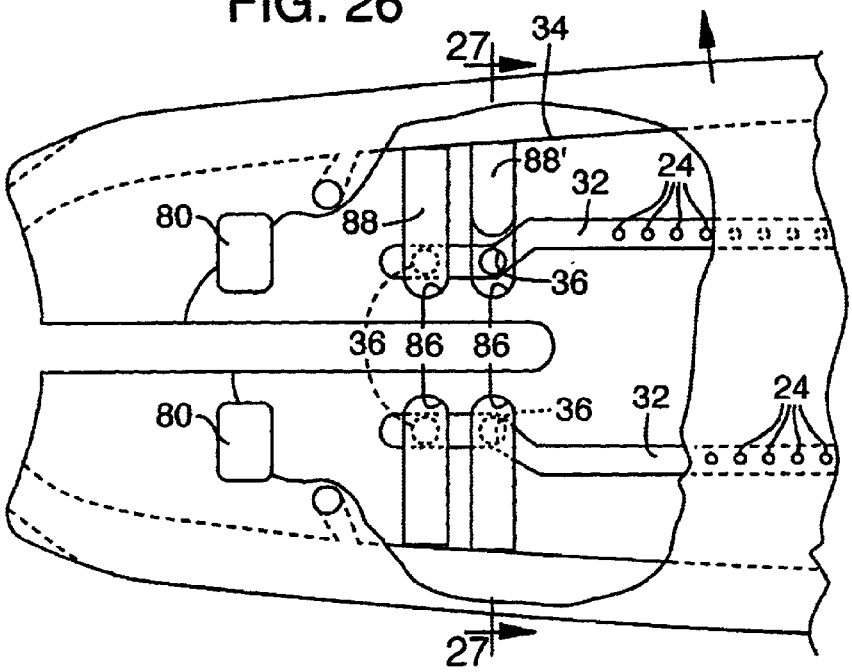
FIG. 27
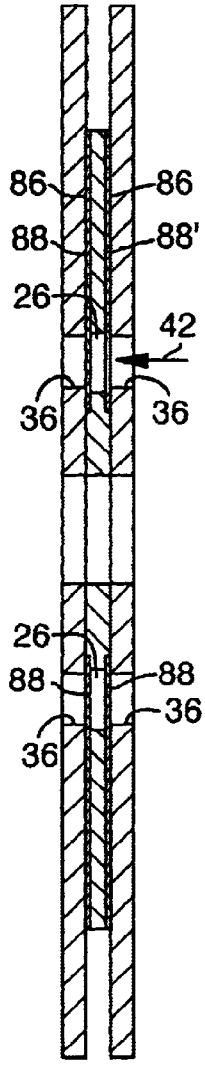
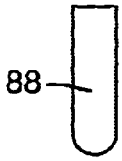
FIG. 28A
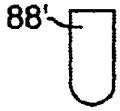
FIG. 28B

FIG. 29
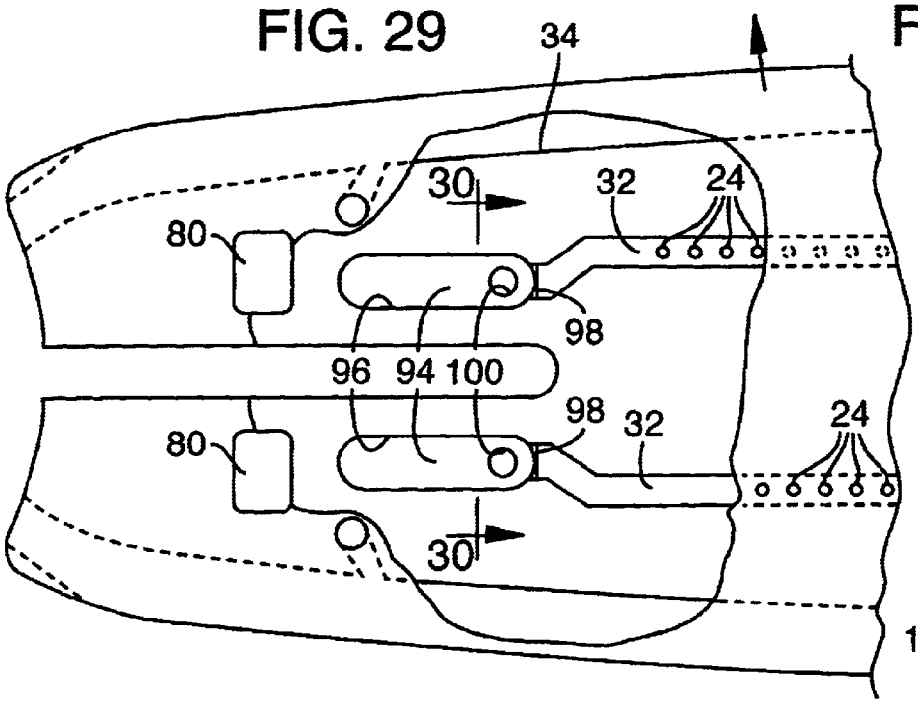
FIG. 30
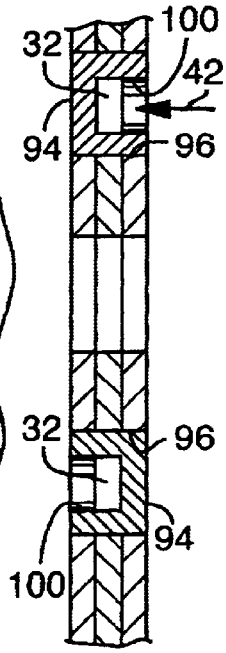
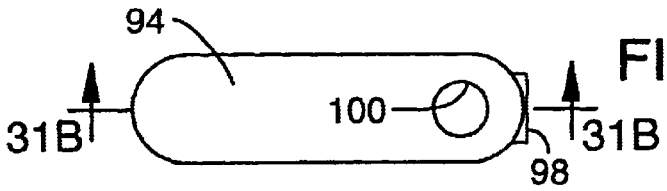
FIG. 31A
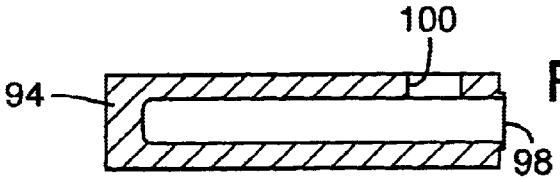
FIG. 31B

GUIDE BAR FOR CHAIN SAW INCLUDING STUMP TREATMENT

FIELD OF THE INVENTION

This invention relates to the treatment of tree stumps and more particularly the application of a liquid treatment material flowed onto a tree stump through a guide bar simultaneous with the falling of a tree.

BACKGROUND OF THE INVENTION

It has been discovered that the severed surface of a stump resulting from tree falling is susceptible to growing undesired fungus that can and does detrimentally affect surrounding vegetation. In some jurisdictions, treatment of the severed surface is mandated to prevent such growth. Whereas a form of treatment is to equip a worker with a spray bottle who follows the tree harvester and manually sprays the treatment material onto the tree stump, it is more acceptable to incorporate the treatment process in the tree cutting procedure. Thus, a guide bar is provided with a feed channel along its length and the liquid material is directed from a reservoir of the liquid material (provided, e.g., on the tree harvester) into the channel. Small dispersal holes on the bottom side of the guide bar and in communication with the feed channel releases the liquid treatment onto the stump surface but without applying material onto the severed end of the log that is cut from the tree stump, it being undesirable to apply the treatment onto the wood that is to be sawn into lumber.

Guide bars have long been produced with feed channels for dispensing lubricant into the guide grooves for lubricating the chain. Certain of this technology is applied to the dispersement of the liquid stump treatment. The bar is provided with an inlet hole that is aligned with a conduit that extends from a reservoir provided on the tree harvester. The inlet hole directs the liquid treatment into the feed channel and onto the stump through appropriate dispersal holes. The solution as described does not totally take care of the dispersement requirement as the bars are made to be reverse mounted, i.e., so that the leading edge becomes the trailing edge and vice versa whereby the top and bottom sides are reversed. Thus, such a bar is provided with two independent sets of dispersal holes (top and bottom) and a second feed channel and top and bottom inlet holes.

The solution is still not complete because different tree harvesters will have reservoir conduits directed to a top or a bottom inlet hole as mounted on the tree harvester. It is not feasible to provide different bars for different harvesters. This means that inlet holes have to be provided for both sides of the bar for both sets of dispersal holes. Complicating the task further is that the locations of the reservoir conduits may require different locations of the inlet hole along the bar length (whether top or bottom) so that several inlet holes at different locations on both sides need to be provided if a standard bar is to fit the numerous different tree harvesters.

The inlet holes into the particular feed channel to be used for treatment dispersal must either be connected to the reservoir conduit or must be plugged. An unplugged inlet hole will result in leaking of the treatment material onto the equipment and the surrounding area which is not acceptable.

SUMMARY OF THE INVENTION

Plugging undesired inlet holes is a problem for operators. Not only does the operator have to figure out which holes have to be plugged, it is also important that the plugs are properly installed, i.e., to properly seal the hole and to avoid any portion of the plug from penetrating above the bar surface. Such plugs have to be fit entirely in the inlet hole and are difficult to handle. It is accordingly an object of the present invention to provide an improved inlet hole plugging system that facilitates the task of plugging the unused inlet holes of a guide bar.

Ideally the bar is a laminate bar which consists of a center laminate fused between two outer laminates. The feed channels are formed in the center laminate and matching inlet holes are provided in the outer laminates. When assembled together, the inlet holes are aligned with each other and with a channel portion that receives and transmits the liquid treatment. The receiving channel portion is enlarged over that of the inlet holes and the remainder of the channel. A disk placed in the enlarged channel portion prior to assembly is thereby trapped between the two inlet holes, i.e., it is oversized relative to the inlet holes and to the remaining channel so that it will stay within the enlarged channel portion. However, it has a thickness less than the thickness of the center laminate and can move from one side laminate to the other.

A reservoir conduit connected to the inlet hole at either side produces liquid flow into that inlet hole to force the disk against the opposite inlet opening to seal off that hole or opening. Thus, regardless of whether the reservoir inlet connects to the top or bottom of the bar, liquid will enter the channel and not exit the opposed inlet hole.

The above describes a first embodiment of the invention which accommodates a guide bar adapted to fit a standardized tree harvester that directs liquid treatment into the top side of the bar plus a standardized tree harvester that directs liquid treatment into the bottom side of the bar but at the same location lengthways of the bar. Whereas a substantial percentage of tree harvester use is thereby accommodated, those tree harvesters that are not standardized and provide conduit connection at different locations, top and bottom, are not accommodated by this solution.

A second embodiment provides for a guide bar having a number of inlet holes to accommodate a wider range of tree harvesters. Opposing pairs of inlet holes are provided at the different locations as dictated by the different harvesters. A pair of disks that are spring biased apart are provided in each channel portion to close off all inlet openings. Whichever hole is connected to a reservoir conduit, the pressure of the inflow of treatment material forces retraction of that disk and the internal pressure of the liquid treatment material enhances the urging of the other disks against the respective inlet openings to prevent leakage of the material.

A still further embodiment provides each inlet hole with laterally directed narrow passages or grooves between the laminates, in some cases leading from the inlet hole to the guide slots of the edge and in other cases leading from the inlet holes to the mounting slot. Manually insertable strips are pressed into these narrow passages or grooves and over the holes to close off the holes not in use. Because the narrow passage also leading to the to-be-used inlet hole also needs to be closed, a blocking strip is inserted into that passage but not across the hole.

Whereas the invention is preferably applied to laminate bars, a solid bar may also be equipped with the inlet holes and channels as required for the invention. For example, tubes can be embedded in the solid bars to form channels and inlet openings.

These and other variations of the invention will be more readily understood and appreciated upon reference to the following detailed description and accompanying drawings referred to therein.

DESCRIPTION OF THE DRAWINGS

FIGS. 8 and 9 illustrate a third embodiment of the invention;

FIGS. 10 and 11 illustrate a fourth embodiment of the invention;

FIGS. 23–25 illustrate an eighth embodiment of the invention;

FIGS. 26–28 illustrate a ninth embodiment of the invention; and

FIGS. 29–31 illustrate a tenth embodiment of the invention.

DESCRIPTION OF THE PREFERRED EMBODIMENT

Figure 1:
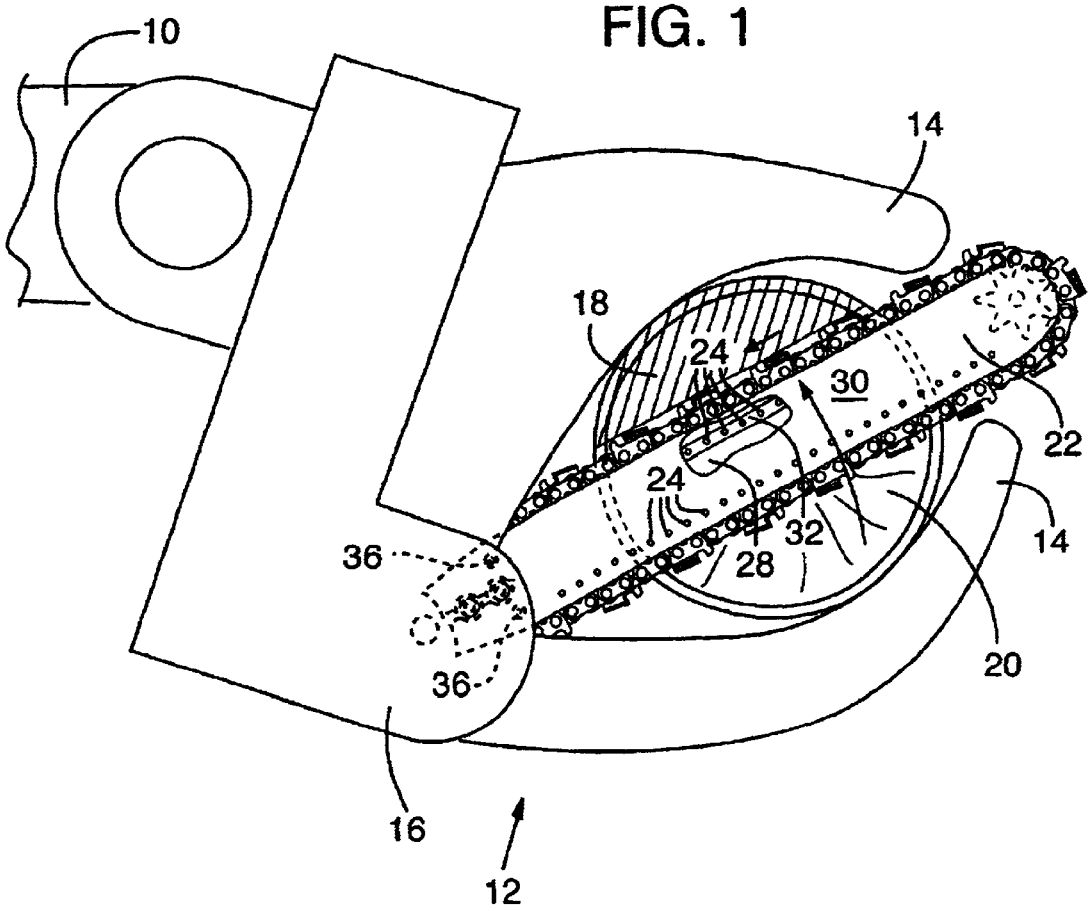
FIG. 1 is a schematic illustration of a tree harvester severing a tree while treating the severed surface of the stump in accordance with the present invention.

Reference is made to FIG. 1 which schematically illustrates a boom 10 of a tree harvester supporting a harvester head 12 at the distal end of the boom 10. The harvester head 12 includes grapples 14 and a chain saw 16 for gripping the tree and severing a log 18 and in the process leaving a tree stump 20. As the tree is being severed, a liquid treatment flows from a reservoir carried by the harvester head 12 into channels provided in the bar 22 (to be explained hereafter) and out dispersal holes 24 in the bottom of the guide bar 22. This procedure spreads a coating of the liquid treatment onto the freshly sawn surface of the stump 20 but not on the freshly sawn adjacent surface of the log 18.

Figure 2:
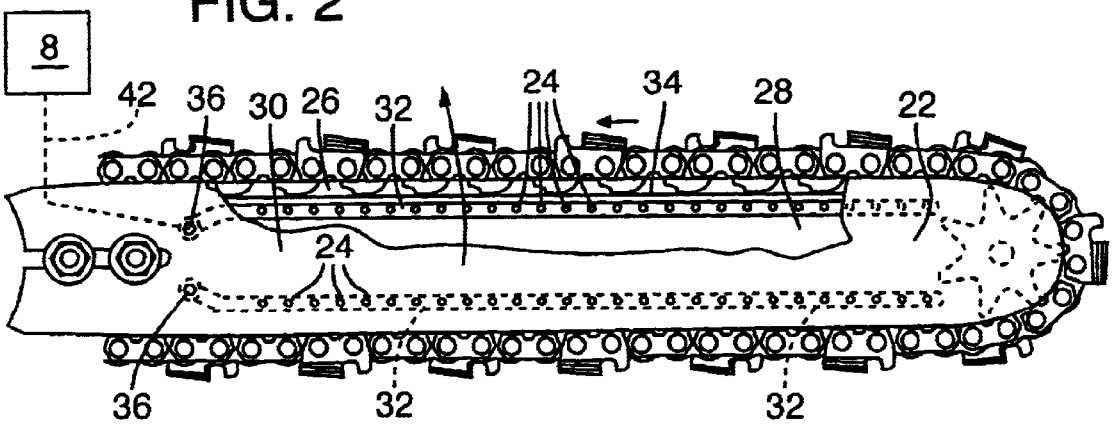
FIG. 2 illustrates a guide bar shown partly in section to illustrate the flow path of treatment material that is provided in a guide bar of the present invention.

FIG. 2 illustrates a guide bar 22 which includes a bottom laminate 26, a center laminate 28 and a top laminate 30. The bottom laminate 26 has dispersal holes 24 underlying channel 32 in the center laminate 28. As common to guide bar production, the center laminate is inset from the top and bottom laminates to produce a guide groove 34. Providing liquid treatment to the channel 32 and thus to the dispersal holes is accomplished by a reservoir 8 connected by conduit 42 to inlet hole 36.

As explained in the Brief Description of the Invention, the guide bar is typically invertible and when inverted, the top becomes the bottom and the top dispersal holes 24 (now the bottom dispersal holes) are connected to a further channel 32 which in turn is connected to a further inlet hole 36. As also explained, commonly there are opposed holes 36 top and bottom for each position (upper and lower as viewed in FIG. 2). It will be apparent that whichever dispersal holes are to be used, there are upper and lower inlet holes and one of them needs to be plugged or the treatment liquid will simply flow through the bar from top to bottom or vice versa.

Figure 3:
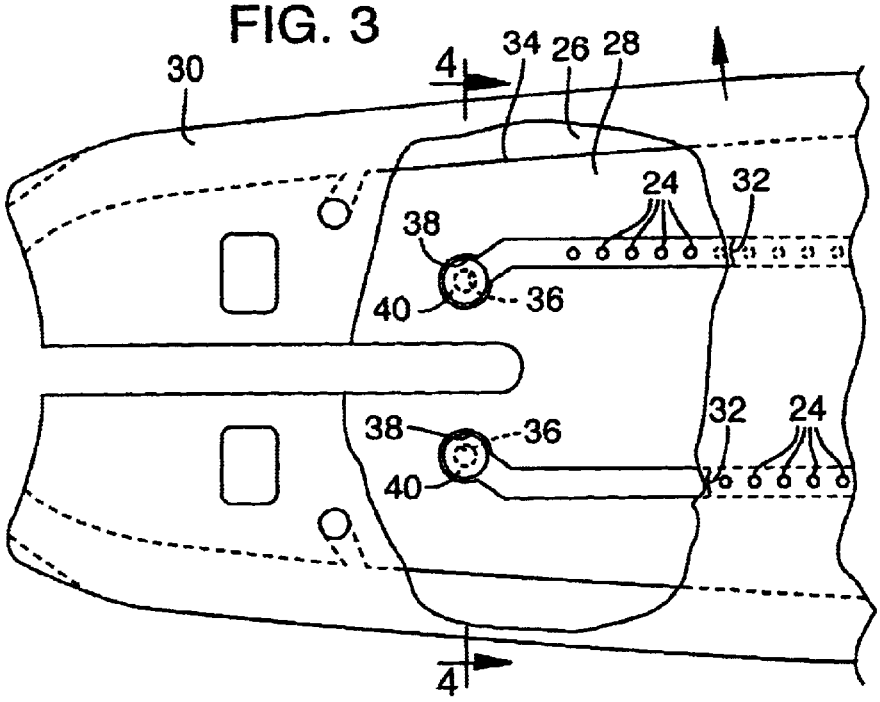
FIGS. 3 and 4 illustrate a first embodiment of the invention.
Figure 4:
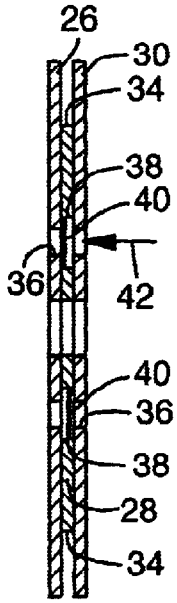

FIGS. 3 and 4 illustrate a first embodiment of the invention. FIG. 3 illustrates a bottom laminate 26 and an overlaid center laminate 28. The top laminate 30 is shown partially removed to expose the channels 32 in the center laminate 28 and the dispersal holes 24 in the bottom laminate (underlying the channel 32). At the inner end of each channel 32 is an enlarged channel portion 38. The channel portion 38 is substantially circular and inserted into the channel portion 38 is a floating disk 40. Note from FIG. 4 that the disk 40 is substantially thinner than the center laminate 28 but is substantially the same size but slightly smaller circumferentially than the channel portion 38 but it is larger than inlet holes 36. Thus, the disk 40 is free to shift to one side or the other, i.e., into abutment with laminates 26 or 30 but is trapped within the enlarged channel portion 38 and between the outside laminates (26, 30). (The disks and confining openings (e.g., 40, 36) are shown in circular configuration but can readily (and in some instances preferably) be provided in other configurations such as oval, rectangular, etc.)

FIG. 4 illustrates a reservoir conduit connection to the upper inlet hole 36 of the top laminate 30 (see arrow 42). As illustrated, the fluid pressure forces the disk 40 against inlet hole 36 in the bottom laminate whereby the only path available for liquid flow is into upper channel 32 (as seen in FIG. 3). As illustrated, the dispersal holes 24 corresponding to the channel 32 at the upper position of the guide bar (as viewed in FIG. 3) are provided only in the bottom laminate. When mounted onto the chain saw 16, the bottom laminate would be placed into engagement with the sawn surface of the stump.

It will further be appreciated that if the conduit was inserted through the opposed hole 36 (opposite arrow 42), the only difference would be the shifting of the disk 40 to the opposite side.

Figure 7:
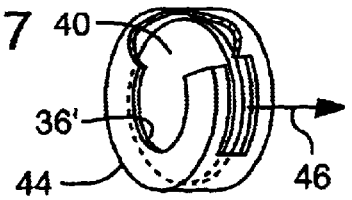
FIGS. 5–7 illustrate a second embodiment of the invention.
Figure 5:
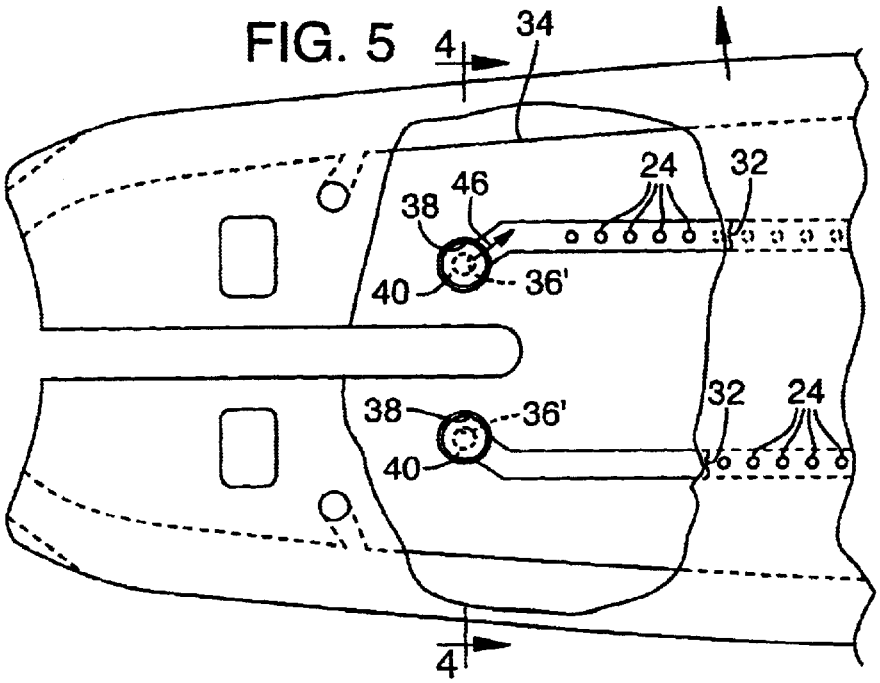
Figure 6:
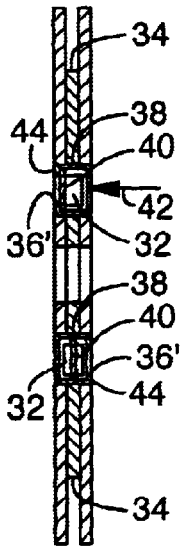
Figure 12:
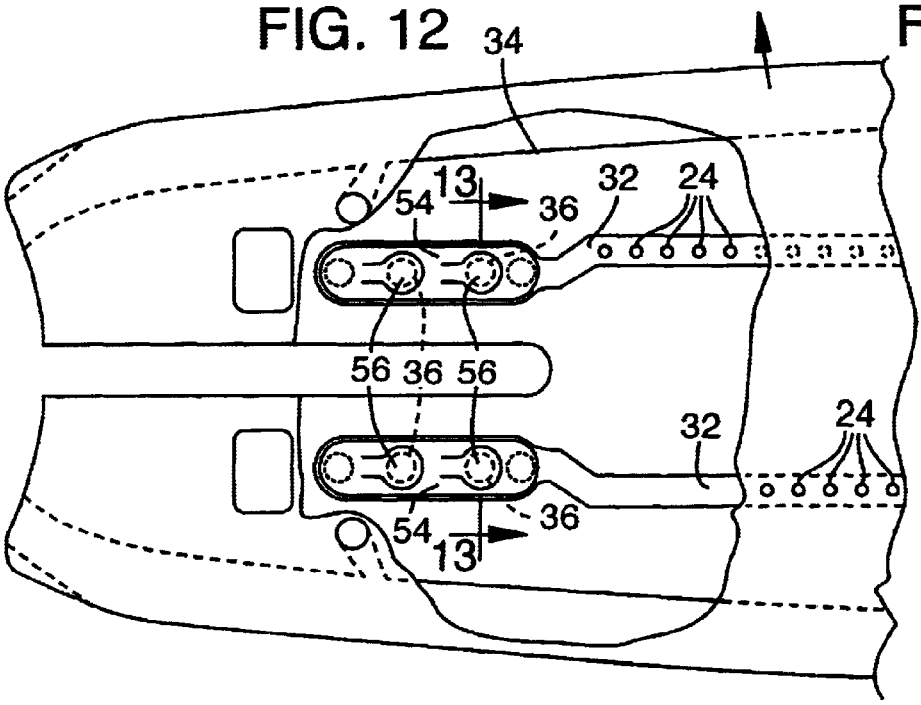
FIGS. 12–15 illustrate a fifth embodiment of the invention.

FIGS. 5–7 illustrate a variation of the embodiment of FIGS. 3 and 4. The laminates are similar to that of FIGS. 3 and 4 except that the holes formed in the outer laminates are the same size as the channel portion 38. A container 44 (see FIG. 7) is sized to fit the through bore defined by the holes in the outer laminates and channel portion 38. Container 44 houses disk 40 and allows the disk to move from side to side. Opening 36' in the container 44 are adapted to connect to the reservoir conduit and opening 46 in the periphery of the container 44 (see FIG. 7) is aligned with the direction of the channel 32 whereby fluid from the conduit directed through an opening 36' first moves the disk 40 to close off the opposite opening 36' and then directs the fluid through opening 46 and into the channels.

Reference is now made to FIGS. 8 and 9 which illustrate a third embodiment. This embodiment is designed to accommodate a wider variation of harvesters. As illustrated, there are three inlet holes 36, in both upper and lower positions, and both top and bottom locations (12 in total) as viewed in the figure (top being right side and bottom being left side in section view FIG. 9). The two channels 32 are not connected as each channel 32 (and the portals and inlet connected thereto) are independently operable one from the other and the liquid material is connected to one only of the channels 32, the other channel being non-operable. However, as concerns whichever channel is operable, there are six inlet holes 36, and liquid material can and will flow into or out of whichever of these inlet holes are open. Accordingly, all but one of the inlet holes (the inlet hole connected to the reservoir) needs to be closed, i.e., plugged.

The structure and relationship of the inlet holes 36 in the outer laminates 26', 30' and the channels 32 in the inner laminate 28' are similar to that of FIGS. 3 and 4, the difference being that the channels 32 are extended to encompass the additional inlet hole locations and additionally the manner of closing the five unused inlet holes. As seen in FIG. 9, the single disk of FIGS. 3 and 4 are replaced with a double disk arrangement 48 which includes a pair of disks biased apart by a spring 50. The disks are cup shaped for seating of the springs as illustrated. In the lower position of FIG. 9, the disks are biased apart and close off the inlet holes 36. At the upper position, the inlet flow 42 forces the corresponding disk inwardly, thereby compressing the spring 50 to open that inlet hole while providing outwardly directed pressure against all other disks connected to that channel.

A fourth embodiment is illustrated in FIGS. 10 and 11. This embodiment is similar to the embodiment of FIGS. 8 and 9, the difference being the unitized double disk and spring arrangement 52. The connecting web 54 between the disk portions 56 functions as a spring that biases the disk portions 56 apart in the same manner as explained for FIGS. 8 and 9.

Figure 13:
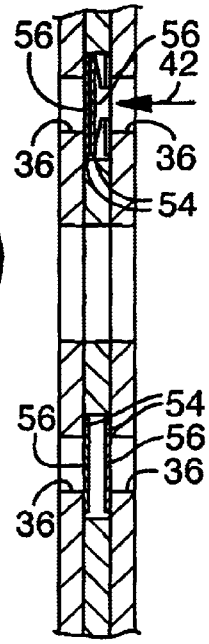
Figure 14:
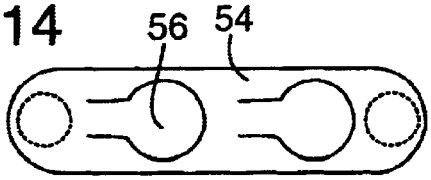
Figure 15:
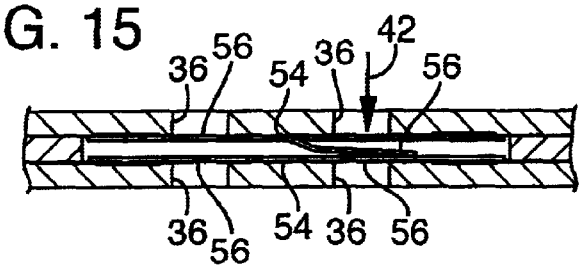
Figure 16:
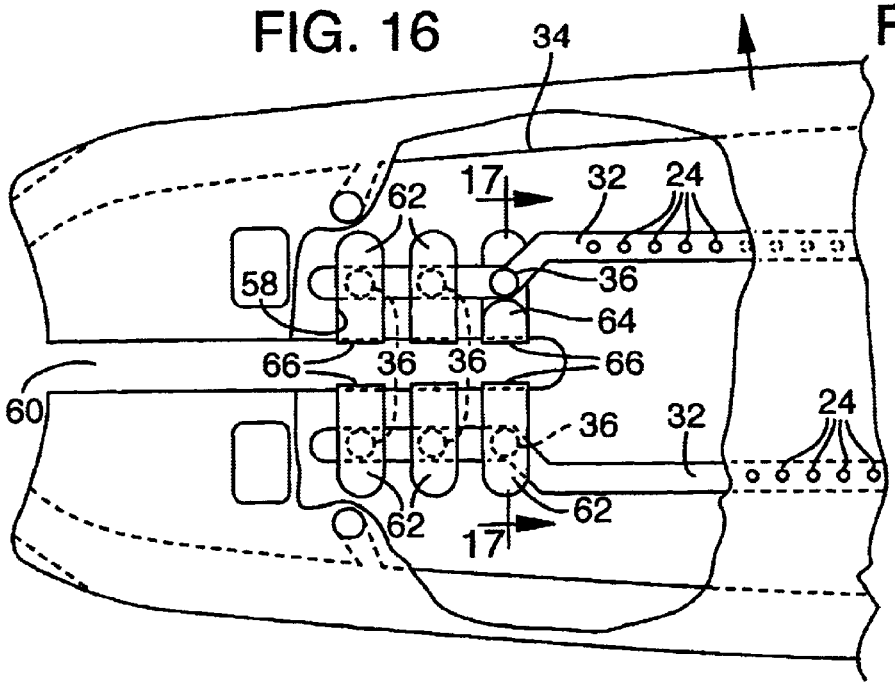
FIGS. 16–19 illustrate a sixth embodiment of the invention.

FIGS. 12–15 illustrate a fifth embodiment. Again the configuration of the inner and outer laminates is similar to that of FIGS. 8 and 9 except that the channel portions overlying the inlet holes are configured to receive templates 54. Templates 54 are secured as by welding to the inside of the outer laminates and so as to place a flap valve 56 of the template over each of the inlet holes 36. (The flap valve being larger than the inlet hole.) As illustrated in the top of FIG. 13 and in FIG. 15, fluid pressure 42 forces the flap valve open and then due to the pressure within the channel, the remaining valves are urged to a closed position.

The above embodiments are considered to be automatic versions of the invention in that an operator doesn't have to make a determination of which inlet holes are to be blocked and which are left open. The invention, however, contemplates improvements to the manual selection and blocking of the unused inlet holes which will now be discussed.

Figure 17:
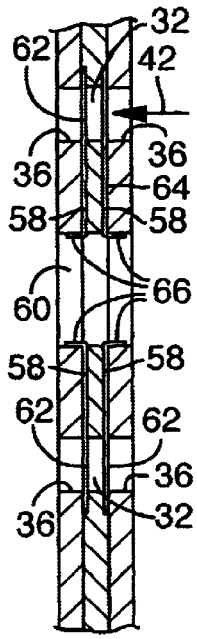

FIGS. 16–19 illustrate a first version of a manual embodiment of the invention. This embodiment includes six inlet holes 36 for each channel 32. As can be seen in FIG. 17, grooves or depressions 58 are provided in the center laminate which forms a passageway between the motor mount slot 60 and the inlet holes 36. Cut off slide tabs 62 and a block slide tab 64 are sized to fit into the grooves 58. The length of the tabs 62 is sufficient to extend past inlet opening 36 to shut off flow of liquid from the channels 32 to inlet hole 36. (See FIG. 16) Because the grooves 58 provide a passageway for liquid to flow through, a block slide tab 64 is inserted into the groove 58 connected to the inlet hole 36 to which the reservoir conduit 42 is to be connected (illustrated for the far right, top inlet hole 36 in FIG. 16).

Figure 18:
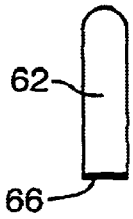
Figure 18A:
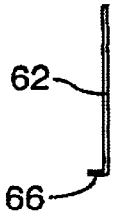
Figure 19:
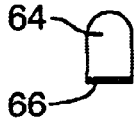
Figure 19A:
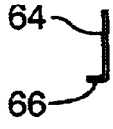
Figure 20:
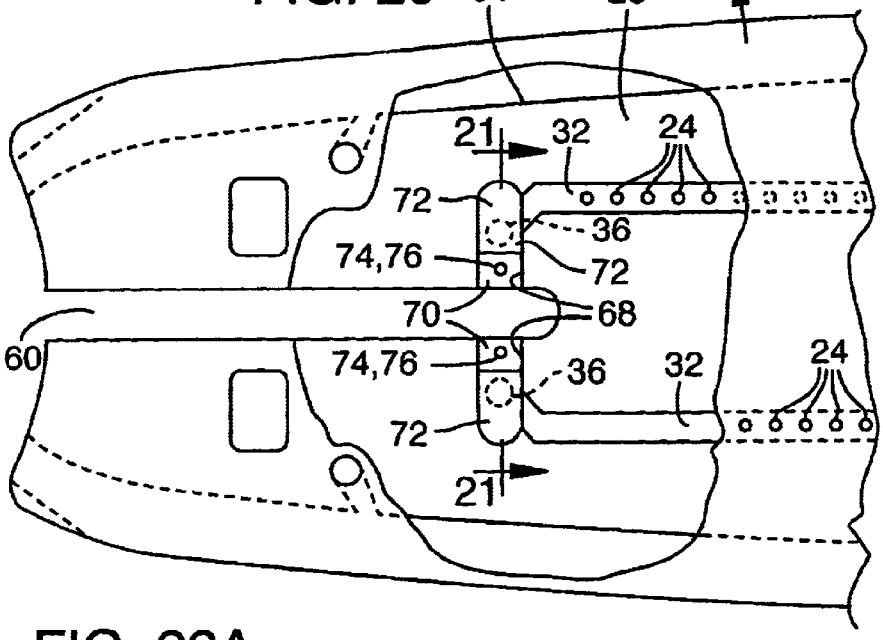
FIGS. 20–22 illustrate a seventh embodiment of the invention.
Figure 21:
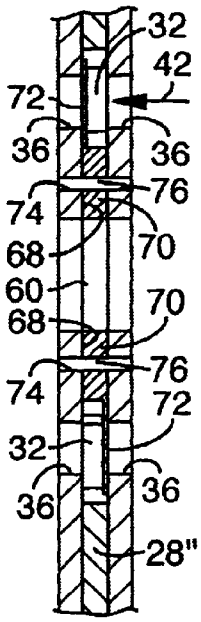
Figure 22A:
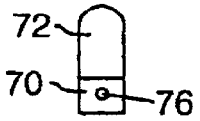
Figure 22B:
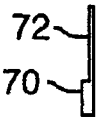

The tabs 62 and 64 may be provided with finger holds 66 to facilitate insertion and removal of the tabs as illustrated in FIGS. 18A and 19A. It will be appreciated that the tabs need to be inserted into the grooves 56 only for one set of the inlet holes 36, i.e., the upper or lower set of holes as viewed in FIG. 16. The tabs need to be inserted into both the bottom and the top grooves of that set of inlet holes 36 connected to the channel 32 through which the fluid is to be flowed. Five of the cut off tabs will be used to close five of the six inlet holes. A blocking tab 64 is inserted into the groove 58 that serves the inlet hole 36 that will be connected.

FIGS. 20, 21 and 22A and 22B illustrate yet a further manual embodiment. The center laminate or core 28" has channel extensions 68 from the inlet hole positions 36 laterally to the motor mount slot 60. Plugs 70 are configured with a base portion that plugs the channel extension 68 with an end portion 72 that fits over the inlet hole 36 on one of the outer laminates. Insertion of the plug closes whichever of the inlet holes is not in use. An advantage is that a single plug provides the equivalent of both the blocking tab and the cut off tab in the prior embodiment (FIGS. 16–19). To prevent loosening of the plug, a pin may be inserted through aligned pin holes 74 and 76 of the side laminates and plugs, respectively.

FIGS. 23, 24 and 25A and 25B illustrate a further manual version of the invention. Groves 82 are formed in the center laminate 28'" extended between the position of the inlet holes to the adjustment hole 80 of the bar (a hole that is commonly provided through the total thickness of the bar). Tabs 78 and 78' (FIGS. 25A and 25B) are inserted from adjustment holes 80 and into the grooves 82. Depending on which of eight inlet holes 36 that are to be connected to the reservoir conduit, tab 78 is inserted into the corresponding groove with the opening 84 either forward or rearward to line up with that inlet hole. Tab 78' is inserted into the opposing groove to block both inlet holes which otherwise would be connected to the corresponding channel 32 resulting in undesired leaking.

FIGS. 26–28A and 28B illustrate an embodiment similar to that of FIGS. 16–18A and 19A. Grooves 86 are formed in the center laminate directed from the bar slot 34 to the inlet holes 36.

Channel block slide tabs 88 are inserted from the bar slots 34 into grooves 86 for blocking the unused inlet hole while tab 88' blocks the groove but not the inlet opening of the to-be-used inlet hole 36.

FIGS. 29–31A and 31B illustrate a still further manual embodiment. A formed cannister 94 is inset into a cavity 96 provided in the bar that is the thickness of the bar as shown. The cannister has an opening 98 that extends between the cannister interior and channel 32. A side opening 100 is selectively formed in the cannister to mate with the conduit flow 42 of the particular harvester head 12. Thus, the bar is effectively customized to a particular tree harvester. The operator is provided with a hole making tool, i.e., a punch, and determines where opening 100 has to be (but within the confines of the cannister 94) and generates that opening.

The above embodiments are but examples of the manner by which the invention can be incorporated into a guide bar of a tree harvester. Those skilled in the art will be able to provide numerous variations without departing from the invention as defined in the accompanying claims. An example is mentioned briefly in the Background of the Invention where it is explained that the invention may be applied to solid bars rather than the laminate bars of the illustrations. Another example is the provision of the slide grooves which are indicated to be in the center laminates of the illustrated embodiments. They can readily be formed in the outer laminates as well. It is accordingly to be understood and appreciated that the claim limitations are intended to be broadly interpreted and to encompass any and all variations that satisfy such broad interpretation.

The invention claimed is:

1. A guide bar for a chain saw comprising:

an elongate planar bar defining a length and having opposed exterior flat sides and a peripheral guide edge, and a rear region of the bar that mounts onto the chain saw;

an elongate channel between the sides and extending lengthwise along the bar length and a series of spaced apart dispersal holes extended laterally from the elongate channel to one of said sides;

at least two inlet holes in the rear region of the bar and both connected to said channel, said inlet holes adapted for connection to a reservoir conduit whereby upon connection of said conduit to one of said inlet holes, liquid treatment from said reservoir conduit is directed into said channel for dispersal through said dispersal holes, the other of said inlet holes requiring closure to prevent outflow there through of said liquid treatment;

a closure for each of said holes comprising:

said inlet holes each defining an outer side exposed to the bar exterior for connection to said reservoir conduit and defining an inner side having a surrounding inner edge, a closure member movable between engaging and non-engaging positions relative to said surrounding inner edge whereby internal pressure produced by treatment flow into the channel from another inlet hole urges the closure member into sealing engagement with said inner edge of said inlet hole.

2. A guide bar for a chain saw as defined in claim 1 wherein:

said two inlet holes are positioned at opposite sides of the bar and in alignment with one another and a channel portion positioned between said inlet holes, said channel portion defining a depth and having a circumference greater than said inlet holes, a disk providing said closure member having a circumference greater than said inlet holes and a thickness less than the depth of the channel portion whereby liquid flow into said channel portion through one of said inlet holes forces movement of said disk against the opposite inlet hole to close off liquid flow through said opposite inlet hole.

3. A guide bar as defined in claim 1 wherein: said two inlet holes are positioned at opposite sides of the bar and in alignment with one another and a channel portion positioned between said holes to cooperatively define a through cavity, a cannister fitted to said cavity and as fitted to said cavity providing opposed side wall portions of said opposed sides of the guide bar and defining a space between said side wall portions, an inlet opening in each side wall portion of the cannister and an outlet opening from the cannister to said channel; and a disk in said cannister having a thickness less than the space between said wall portions and a circumference greater than the inlet openings whereby liquid treatment that flows into one of said inlet openings forces movement of the disk for closing the other inlet opening.

4. A guide bar for a chain saw as defined in claim 1:

said at least two inlet holes are provided as one or more pair of inlet holes, each pair including an inlet hole at each side of the bar and aligned with the other one of the pair of inlet holes, and the pair of inlet holes aligned with a channel portion, a pair of closure members in said channel portion and biased apart by a spring member and into closing engagement with the aligned inlet holes, either of said closure members being forced inwardly to an open position upon connection of the flow of liquid treatment from said reservoir conduit.

5. A guide bar for a chain saw as defined in claim 4 wherein the pair of closure members are interconnected by a web, the web providing said spring member biasing the closure members apart.

6. A guide bar for a chain saw comprising:

an elongate planar bar defining a length and having opposed exterior flat sides and a peripheral guide edge, and a rear region of the bar that mounts onto the chain saw;

an elongate channel between the sides and extending lengthwise along the bar length and a series of spaced apart dispersal holes extended laterally from the elongate channel to one of said sides;

at least two inlet holes in the rear region of the bar and both connected to said channel, said inlet holes adapted for connection to a reservoir conduit whereby upon connection of said conduit to one of said inlet holes, liquid treatment from said reservoir conduit is directed into said channel for dispersal through said dispersal holes, the other of said inlet holes requiring closure to prevent outflow of said liquid treatment;

said elongate planar bar including an inner laminate between two outer laminates, said channel formed in said inner laminate and said inlet holes formed in at least one of said outer laminates;

a channel portion positioned in said inner laminate and surrounding said inlet holes of said outer laminates; and a closure for each of said holes comprising:

a valve template within said channel portion overlying and surrounding said inlet holes and secured to an inner wall of said at least one of said outer laminates, a flap valve forming a part of said template, said flap valve overlying each of the inlet holes, said flap valve forced inwardly to an open position in response to exterior flow of liquid treatment to the respective inlet hole and said flap valve forced outwardly against the respective inlet hole to close said inlet hole in response to interior pressure from flow of liquid treatment into the channel from another inlet hole.

* * * * *